US008636283B2

(12) United States Patent
Akiyama et al.

(10) Patent No.: US 8,636,283 B2
(45) Date of Patent: Jan. 28, 2014

(54) SHEET TRANSPORT APPARATUS WITH JAM CLEARING DIAL

(75) Inventors: Mamoru Akiyama, Yamanashi-ken (JP); Seiji Nishizawa, Chuo (JP); Toshiya Sato, Otsuki (JP); Koji Kanda, Kai (JP); Tetsuya Noda, Minamialps (JP); Toshiyuki Ito, Nirasaki (JP)

(73) Assignee: Nisca Corporation, Minamikoma-gun, Yamanashi-ken (JP)

( * ) Notice: Subject to any disclaimer, the term of this patent is extended or adjusted under 35 U.S.C. 154(b) by 0 days.

(21) Appl. No.: 13/410,986

(22) Filed: Mar. 2, 2012

(65) Prior Publication Data

US 2012/0228822 A1 Sep. 13, 2012

(30) Foreign Application Priority Data

Mar. 8, 2011 (JP) ..... 2011-049802

(51) Int. Cl.
*B65H 5/00* (2006.01)
*B65H 5/36* (2006.01)

(52) U.S. Cl.
CPC ..... *B65H 5/36* (2013.01)
USPC ..... 271/264

(58) Field of Classification Search
USPC ..... 271/264; 399/125, 380
See application file for complete search history.

(56) References Cited

U.S. PATENT DOCUMENTS

| | | | | |
|---|---|---|---|---|
| 7,272,340 | B2 * | 9/2007 | Song | 399/125 |
| 7,726,650 | B2 * | 6/2010 | Tu | 271/273 |
| 8,360,425 | B2 * | 1/2013 | Chng et al. | 271/273 |

FOREIGN PATENT DOCUMENTS

| | | | |
|---|---|---|---|
| JP | 2002278332 A | * | 9/2002 |
| JP | 2005-210184 | | 8/2005 |
| JP | 2010-041464 | | 2/2010 |

* cited by examiner

*Primary Examiner* — Gerald McClain
(74) *Attorney, Agent, or Firm* — Manabu Kanesaka

(57) ABSTRACT

A sheet transport apparatus for transporting a sheet along a transport path has a sheet transport mechanism having a plurality of transport rollers for transporting a sheet; and a jam clearing mechanism for removing the sheet, when the sheet causes a transport failure and is jammed on the transport path. The jam clearing mechanism has a coupling member coupled to a transport roller, a jam clearing dial that transfers a rotation force to the transport roller through the coupling member, and a switching device for switching so that the coupling member separates from the transport roller in transporting a sheet, while being coupled to the transport roller in clearing a jam.

8 Claims, 9 Drawing Sheets

SHEET TRANSPORT APPARATUS WITH JAM CLEARING DIAL

BACKGROUND OF THE INVENTION

1. Field of the Invention

The present invention relates to a sheet transport apparatus provided with a jam clearing mechanism to remove a sheet causing a transport failure such as a sheet jam from a transport path.

2. Description of the Related Art

In an image formation apparatus such as a copier and printer and an image reading apparatus provided in a scanner, facsimile or the like, provided is a sheet transport apparatus which feeds an original (sheet) to each processing section such as a printing section and reading section, and discharges the sheet processed therein. The image formation apparatus and image reading apparatus are provided on their top face with a reading platen for reading the sheet that is placed with the hands. The sheet transport apparatus is provided to be openable and closable above the platen, separates to open the top surface of the platen when a sheet is set on the platen, and is used while being closed to cover the top surface of the platen after the sheet is set.

The sheet transport apparatus is provided with a plurality of transport rollers disposed along a transport path extending from a paper feed tray to a sheet discharge tray via each processing section, and is configured to pick up sheets set on the paper feed tray on a sheet-by-sheet basis to transport to the processing section, and then, discharge the sheet processed in the processing section to the sheet discharge tray. In such a sheet transport apparatus, when a transport failure (jam) occurs at some midpoint in the transport path due to a sheet jam or the like, an open/close cover for maintenance provided in the sheet transport apparatus is opened to expose the transport path, or the sheet transport apparatus itself is separated from the image formation apparatus and image reading apparatus, and the jammed sheet is thereby removed.

Further, there is a sheet transport apparatus provided with an operating dial for jam clearing to manually feed a sheet to a position that enables the jammed sheet to be grasped and pulled out from the outside in removing the jammed sheet. As disclosed in Japanese Unexamined Patent Publication No. 2005-210184 and Japanese Unexamined Patent Publication No. 2010-41464, the operating dial for jam clearing has the configuration that a coupled transport roller always rotates by a driving mechanism provided with a transport motor.

However, in the aforementioned conventional jam clearing mechanism provided with the operating dial for jam clearing, since the rotation mechanism of the operating dial is always coupled to a particular transport roller, a load caused by rotation of the operating dial arises in normal sheet transport in which any jam does not occur. Then, such a load results in upsizing of the driving motor for driving the transport roller and increases in power consumption. Further, there is the risk of causing noise and unusual sound due to rotation of the operating dial.

Many sheet transport apparatuses provided with the conventional operating dial for jam clearing control individually driving of each of some transport rollers among a plurality of transport rollers. Therefore, for example, in the apparatus configured to drive one of two transport rollers comprised of reading roller and sheet discharge roller with a first driving motor, while driving the other roller with a second driving motor, since driving transmission mechanisms of the rollers are not coupled to each other, a plurality of operating dials is required. Further, in the apparatus using a single driving motor, it is possible to control a particular transport roller individually with an electromagnetic clutch or the like, but in a state in which driving of the electromagnetic clutch is released, since the driving transmission mechanisms are not coupled to each other, a plurality of operating dials is eventually required.

When a plurality of operating dial thus exists, such a problem sometimes occurs that breakage of the sheet and sheet jam occur more unless the plurality of operating dials is concurrently rotated in the same direction, and that the state of the jam further deteriorates. Moreover, the operating dials are manually operated, and thereby tend to cause fluctuations in rotation depending on the person who operates, and there is difficulty in operability such that jam clearing action is not performed with reliability.

Therefore, it is an object of the invention to provide a sheet transport apparatus provided with a jam clearing mechanism for enabling sheet transport to be performed smoothly in a normal state, and enabling a sheet to be removed with reliability when a sheet jam or the like occurs, while facilitating feed of the jammed sheet by single rotating operation.

SUMMARY OF THE INVENTION

A sheet transport apparatus of the invention has a coupling member coupled to a transport roller, and a jam clearing dial that transfers a rotation force to the transport roller via the coupling member, switches so that the coupling member separates from the transport roller at the time of sheet transport, while being coupled to the transport roller at the time of removing a jammed sheet, and is thereby capable of removing the jammed sheet with reliability and ease when a sheet jam or the like occurs, without causing any trouble in transporting sheets at the time of normal sheet transport.

DESCRIPTION OF THE PREFERRED EMBODIMENTS

Figure 1:
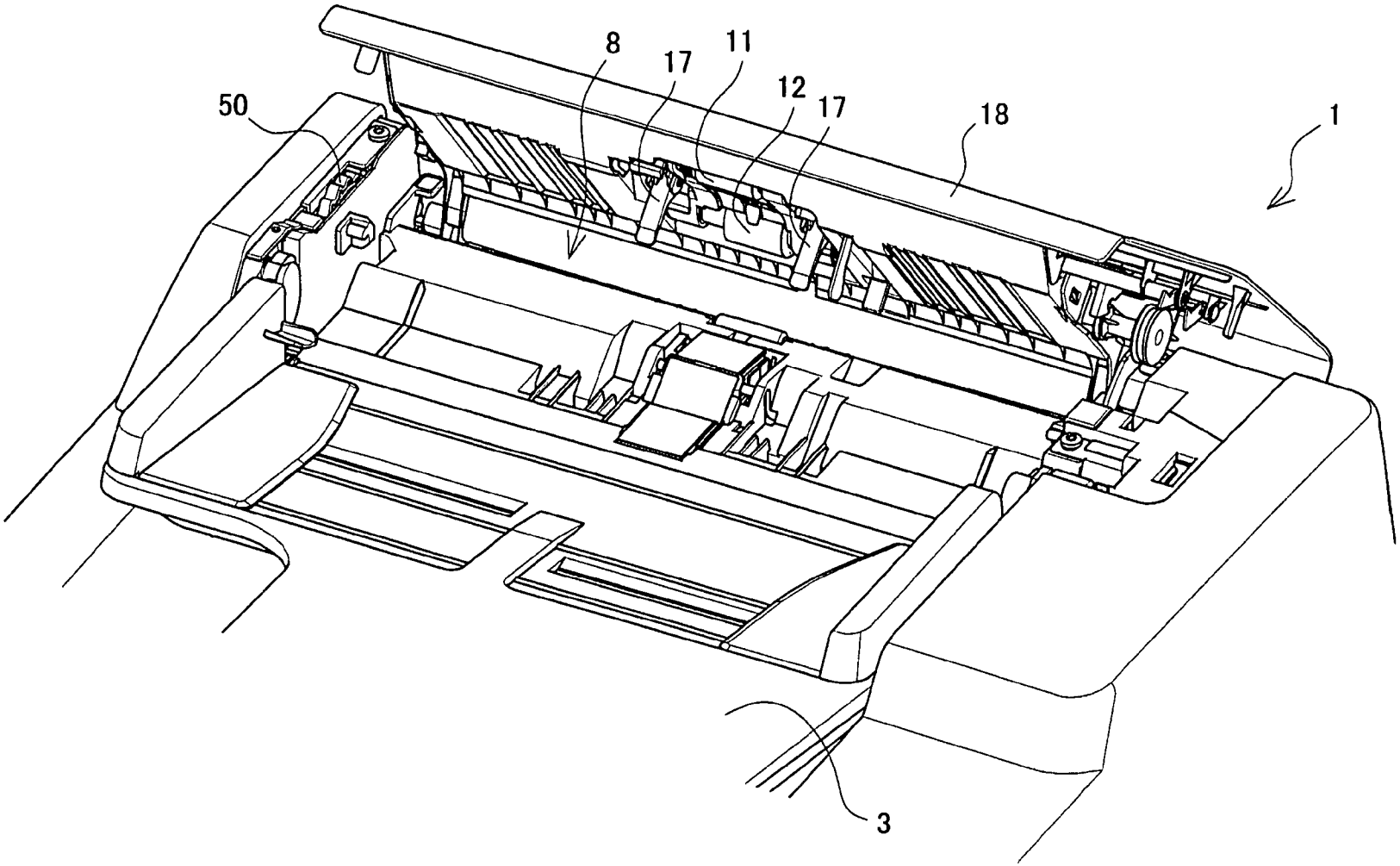
FIG. 1 is a perspective view showing a state in which an open/close cover is opened in a sheet transport apparatus according to the invention.

Embodiments of a sheet transport apparatus according to the invention will specifically be described below with reference to drawings. FIG. 1 is a perspective view showing a state in which an open/close cover for maintenance, provided in the sheet transport apparatus of the invention, is opened. Further, FIG. 2 is a sectional view of principal part showing a configuration of a sheet transport mechanism, and FIG. 3 is a sectional view of principal part of a state in which a jam clearing mechanism is disposed.

Figure 2:
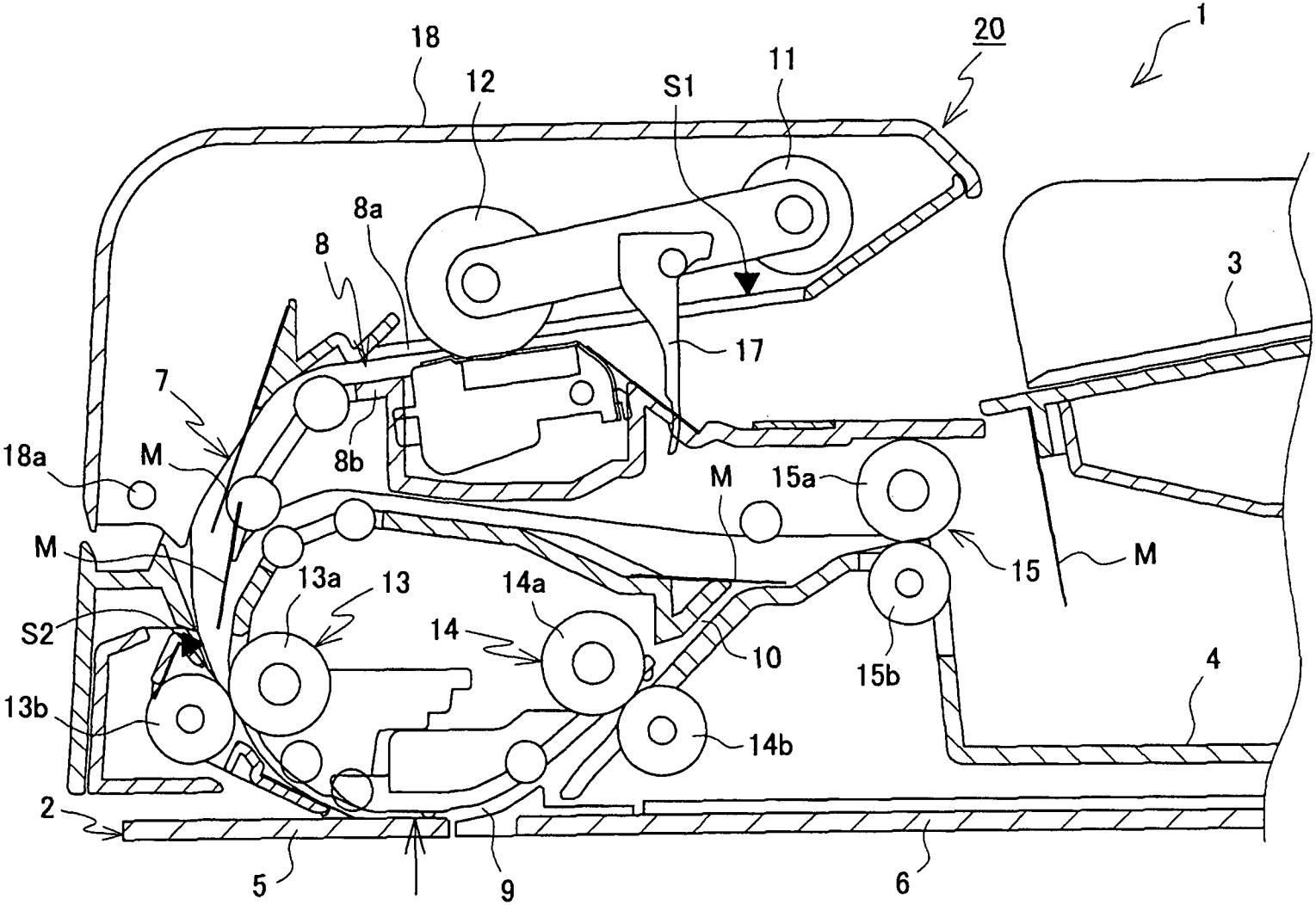
FIG. 2 is a sectional view showing a sheet transport mechanism.
Figure 3:
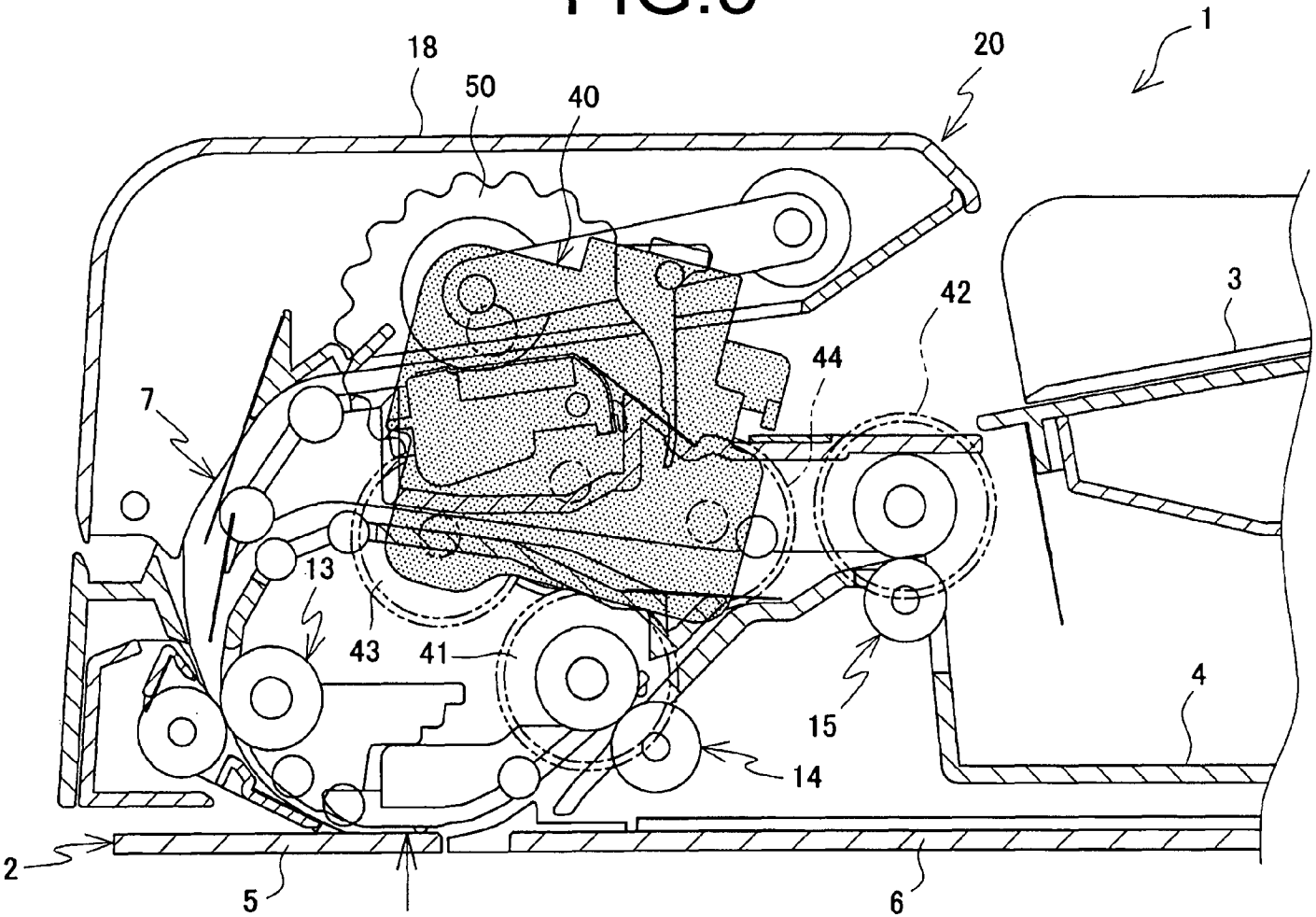
FIG. 3 is a sectional view showing a jam clearing mechanism of Embodiment 1.

As shown in FIG. 2, a sheet transport apparatus 1 is attached to be openable and closable above a reading apparatus body 2 having a first platen 5 for reading a sheet traveling along a transport path 7, and a second platen 6 for reading a sheet mounted with the hands on a sheet-by-sheet basis. Then, the sheet transport apparatus 1 is provided with a sheet transport mechanism 20 for transporting a sheet from a paper feed tray 3 to a sheet discharge tray 4, and a jam clearing mechanism 40 incorporated into the sheet transport mechanism 20 as shown in FIG. 3 to remove a sheet jammed on the transport path 7.

As shown in FIG. 2, the sheet transport mechanism 20 has the transport path 7, curved in the shape of a U, extending from the paper feed tray 3 capable of mounting a plurality of sheets thereon to the sheet discharge tray 4, and a plurality of rollers disposed on the transport roller 7, and is comprised thereof.

The transport path 7 forms a single continued path with a paper feed path 8 for feeding a single sheet from among a plurality of sheets loaded on the paper feed tray 3, a reading path 9 extending from the paper feed path 8 via the first platen 5, and a sheet discharge path 10 continued to the sheet discharge tray 4 from the reading path 9. In addition, each path is provided with a mylar M that guides transport of a sheet at an important point.

As shown in FIG. 2, the paper feed path 8 reserves a space for transporting a sheet with an upper guide plate 8*a* and lower guide plate 8*b*. The upper guide plate 8*a* is fixed to an open/close cover 18 supported rotatably by a rotation shaft 18*a*, and is capable of being opened and closed by operating rotation in a counterclockwise direction viewed in the figure. The open/close cover 18 is provided with a pick-up roller 11 and paper feed roller 12, and integrally rotates. By this means, it is configured that all the paper feed path 8 from the paper feed tray 3 to the front of a register roller pair 13 is opened to be exposed successively, and that it is possible to remove a jammed sheet with ease. Further, by rotating the open/close. cover 18 from a close position for covering the transport path 7 to an open position (upward) for releasing the transport path 7, power supplied to the sheet transport apparatus 1 is interrupted using an interlock switch (not shown). In other words, to ensure safety, all the passage of current is disconnected in electronic parts such as a driving motor, electromagnetic clutch and sensors with the open/close cover 18 opened.

The plurality of rollers is comprised of the pick-up roller 11 to pick up a sheet from the paper feed tray 3, a paper feed roller 12 that feeds the picked-up sheet to the paper feed path 8, a register roller pair 13 that aligns the sheet in front of the first platen 5, a reading roller pair 14 that transports the sheet along the reading path 9, and a sheet discharge roller pair 15 that discharges the sheet to the sheet discharge tray 4.

The pick-up roller 11 comes into contact with the top surface of the sheet mounted on the paper feed tray 3 with the sheet struck against an alignment plate 17 and aligned, and picks up the sheet. In addition, the alignment plate 17 is configured to release the regulation on the sheet when the pick-up roller 11 picks up the sheet. The paper feed roller 12 separates the sheet(s) that is picked up by the pick-up roller 11 to a single sheet to feed toward the paper feed path 8 in cooperation with a separate member.

The register roller pair 13 is comprised of a driving roller 13*a* and driven roller 13*b*, the reading roller pair 14 is comprised of a driving roller 14*a* and driven roller 14*b*, and the sheet discharge roller pair 15 is comprised of a driving roller 15*a* and driven roller 15*b*. In this Embodiment, the register roller pair 13 is disposed in a position close to the first platen 5, and therefore, registers the fed sheet, while transporting the sheet together with the reading roller pair 14 opposed with the first platen 5 therebetween in reading of the sheet.

Meanwhile, as a configuration of the control system, an empty sensor S1 is disposed to detect that sheets are mounted on the paper feed tray 3, and a register sensor S2 that detects the end portion of the fed sheet is disposed in front of the register roller pair 13 inside the paper feed path 8. Each of the sensors S1 and S2 is connected to a control section (not shown) provided with a CPU that controls the entire action of the sheet transport apparatus 1, and a driving motor MOT and first and second electromagnetic clutches CL1 and CL2 as shown in FIG. 4 are controlled based on a detection signal from each of the sensors S1 and S2.

Figure 4:
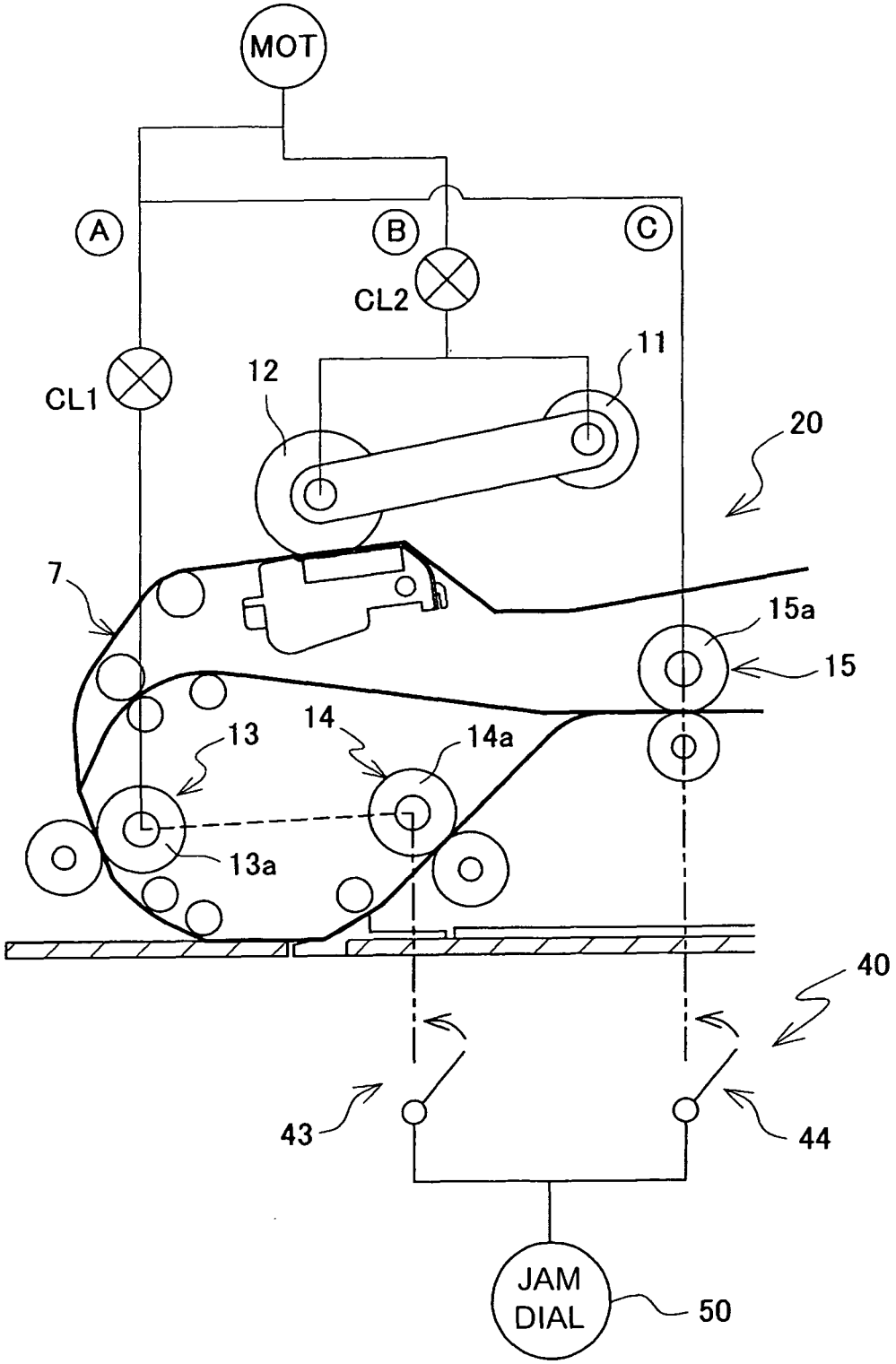
FIG. 4 is a conceptual diagram illustrating a driving system of the sheet transport mechanism and the jam clearing mechanism.

FIG. 4 schematically shows a driving system of the sheet transport mechanism 20 and the jam clearing mechanism 40. The driving source of the sheet transport mechanism 20 is a single driving motor MOT, and three power systems A, B and C separate from the driving motor MOT. The first power system A transfers driving of the driving motor MOT to the driving roller 13*a* of the register roller pair 13 and the driving roller 14*a* of the reading roller pair 14 via the electromagnetic clutch CL1. The second power system B transfers driving of the driving motor MOT to the pick-up roller 11 and paper feed roller 12 via the electromagnetic clutch CL2. The third power system C transfers driving of the driving motor MOT directly to the driving roller 15*a* of the sheet discharge roller pair 15 without using the clutch or the like.

In the jam clearing mechanism 40, driving by rotating operation of a jam clearing dial 50 is transferred to the driving roller 13*a* of the register roller pair 13, the driving roller 14*a* of the reading roller pair 14 and the driving roller 15*a* of the sheet discharge roller pair 15 by shifting of coupling members 43, 44 working like a switch. Although details will be described later, the coupling members 43, 44 cancel driving transmission from the jam clearing dial 50 to the driving roller 13*a* of the register roller pair 13, the driving roller 14*a* of the reading roller pair 14 and the driving roller 15*a* of the sheet discharge roller pair 15 at the time of normal sheet transport. By this means, the jam clearing mechanism 40 is not involved at the time of normal sheet transport, and any excessive load is thereby not imposed on the driving motor MOT. Meanwhile, at the time of clearing a jam, the coupling members 43, 44 are configured to transfer driving transmission from the jam clearing dial 50 to the driving roller 13*a* of the register roller pair 13, the driving roller 14*a* of the reading roller pair 14 and the driving roller 15*a* of the sheet discharge roller pair 15. Accordingly, it is possible to forcibly rotate the driving roller 14*a* of the reading roller pair 14 and the driving roller 15*a* of the sheet discharge roller pair 15 of which rotation is halted by a halt of the driving motor MOT only by manual rotating operation of the jam clearing dial 50.

Figure 5:
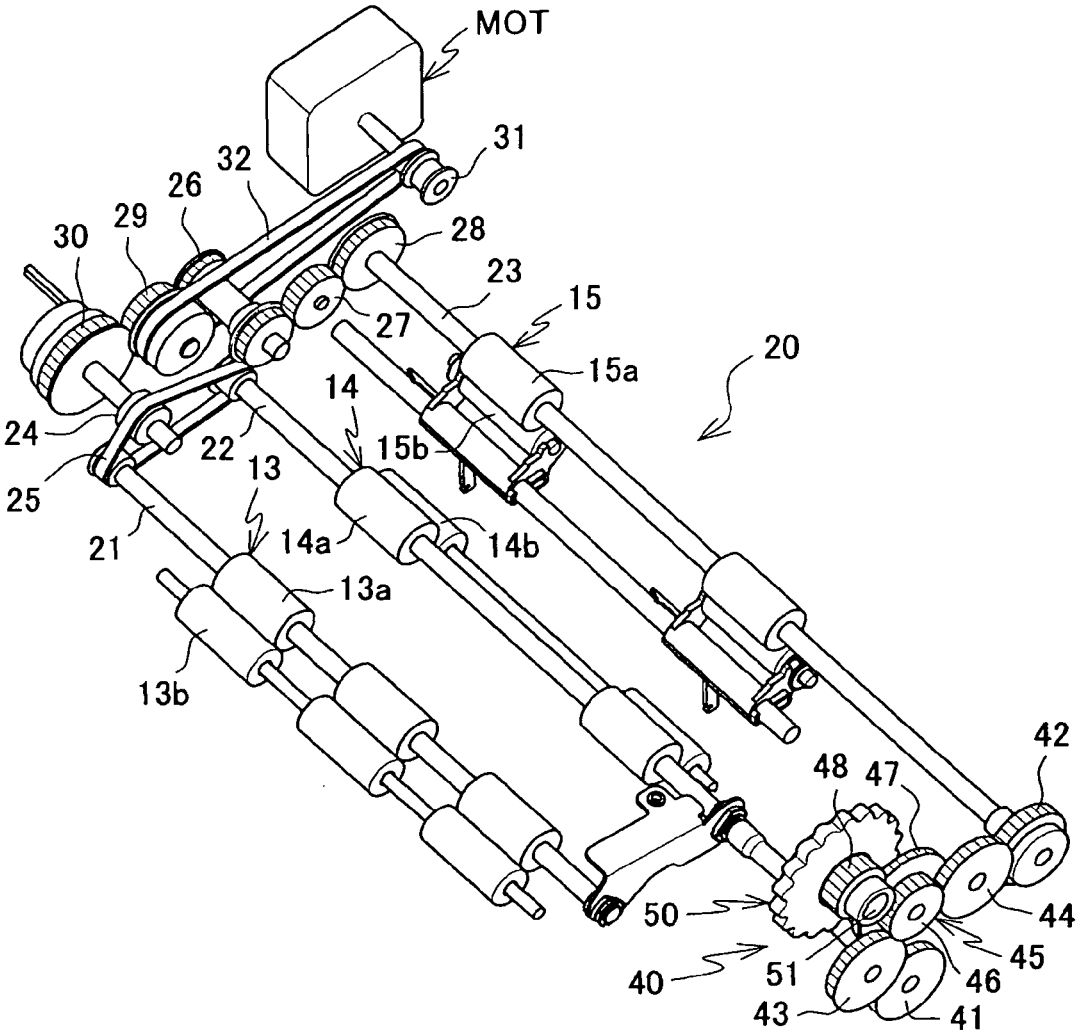
FIG. 5 is a perspective view showing principal parts of the sheet transport mechanism and the jam clearing mechanism.

FIG. 5 shows details of the driving mechanisms of the sheet transport mechanism 20 and the jam clearing mechanism 40. As shown in the figure, the driving mechanism of the sheet transport mechanism 20 is provided on the rear side of the sheet transport apparatus 1, and the driving mechanism of the jam clearing mechanism 40 is provided on the front side of the sheet transport apparatus 1. In the driving configuration of the sheet transport mechanism 20, the driving roller 13*a* of the register roller pair 13 is rotatably supported by a register roller driving shaft 21, the driving roller 14*a* of the reading roller pair 14 is rotatably supported by a reading roller driving shaft 22, and the driving roller 15*a* of the sheet discharge roller pair 15 is rotatably supported by a sheet discharge roller driving shaft 23. Further, base end portions of the register roller driving shaft 21 and reading roller driving shaft 22 are coupled to a rotating shaft 24 via a first timing belt 25, and the rotating shaft 24 is connected to a third gear 30 via the electromagnetic clutch CL1. The third gear 30 is coupled to a second driving gear 29, and is coupled to a first rotating shaft 31 of the driving motor MOT via a second timing belt 32. Further, the second driving gear 29 is coupled to a fourth driving gear 26, and is further coupled to a sixth driving gear 28 provided at one end of the sheet discharge roller driving shaft 23 via a fifth gear 27. Then, when the driving motor MOT is rotated in the right direction or left direction, the register roller driving shaft 21, reading roller driving shaft 22 and sheet discharge driving shaft 23 rotate concurrently in the same direction via each driving gear and timing belt. In addition, the electromagnetic clutch CL1 provided in the third driving gear 30 couples the third driving gear 30 to the rotating shaft 24 by the passage of current, and releases coupling of the third driving gear 30 to the rotating shaft 24 by disconnecting the passage of current.

The jam clearing mechanism 40 will be described next. The jam clearing mechanism 40 is provided with first coupling member and second coupling member disposed to enable the members to be coupled to each other. The second coupling member is comprised of a reading roller rotating gear 41 provided in the front end portion of the reading roller driving shaft 22, and a sheet discharge roller rotating gear 42 provided in the front end portion of the sheet discharge roller driving shaft 23. Meanwhile, the first coupling member is comprised of a reading driving gear 43 provided to be able to separate and be coupled from/to the reading roller rotating gear 41, and a sheet discharge driving gear 44 provided to be able to separate and be coupled from/to the sheet discharge roller rotating gear 42. Further, the reading driving gear 43 and sheet discharge driving gear 44 are provided with rotation transfer means (rotation transfer gear) 45 to mesh. The rotation transfer gear 45 has an inside diameter gear 46 coupled to the reading driving gear 43 and the sheet discharge driving gear 44, and an outside diameter gear 47 provided outside the inside diameter gear 46, and is comprised thereof. The jam clearing dial 50 has an inside diameter gear 48 meshing with the outside diameter gear 47 of the rotation transfer gear 45, and transfers the rotation force to the reading driving gear 43 and the sheet discharge driving gear 44 via the rotation transfer gear 45.

The reading driving gear 43, sheet discharge driving gear 44, rotation transfer gear 45 and jam clearing dial 50 are stored in a box-shaped support member (holder) 52 as shown in FIG. 3, and are respectively held rotatably. Further, the holder 52 constitutes switching means, provided swingably inside the sheet transport mechanism 20 via a dial rotating shaft 51 rotation-supporting the jam clearing dial 50 and a biasing member (biasing spring) 53, switched between a position in sheet transport and a position in jam clearing. The switching means synchronizes with open/close action of the open/close cover 18, and the holder 52 swings in a clockwise direction and a counterclockwise direction about the dial rotating shaft 51.

Figure 6:
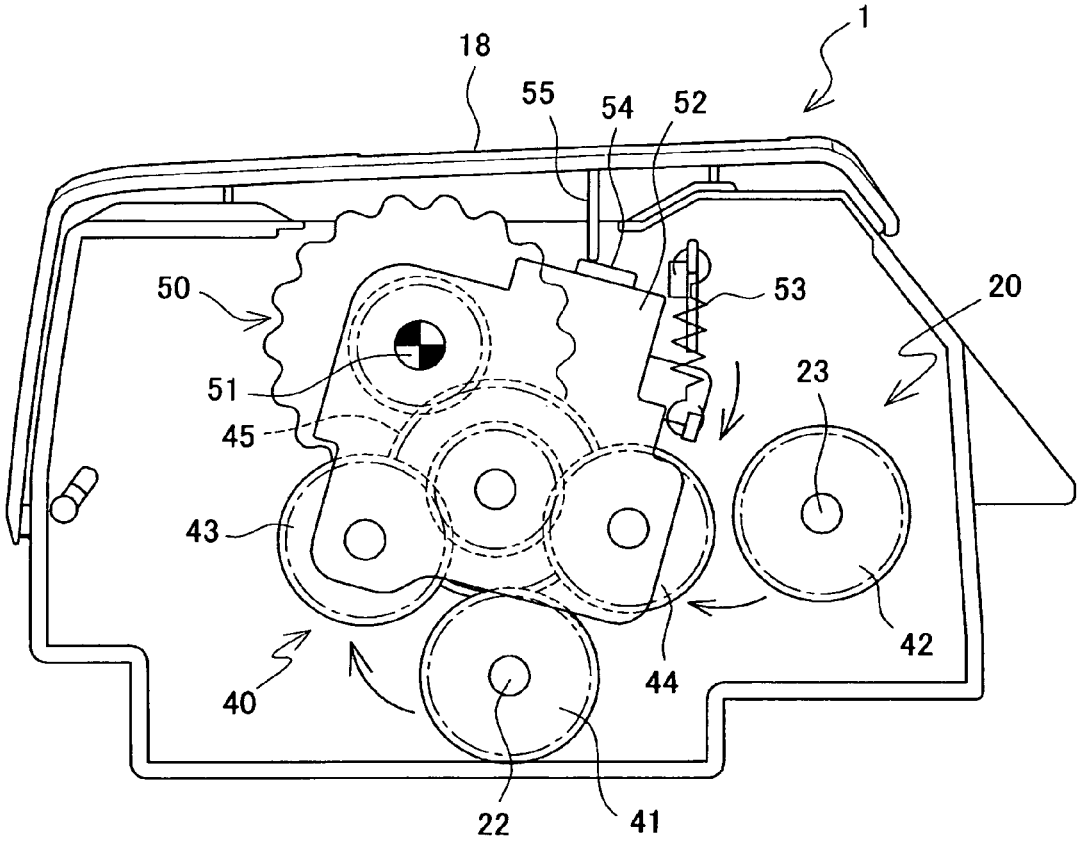
FIG. 6 is a sectional view illustrating action of the jam clearing mechanism when the open/close cover is closed.
Figure 7:
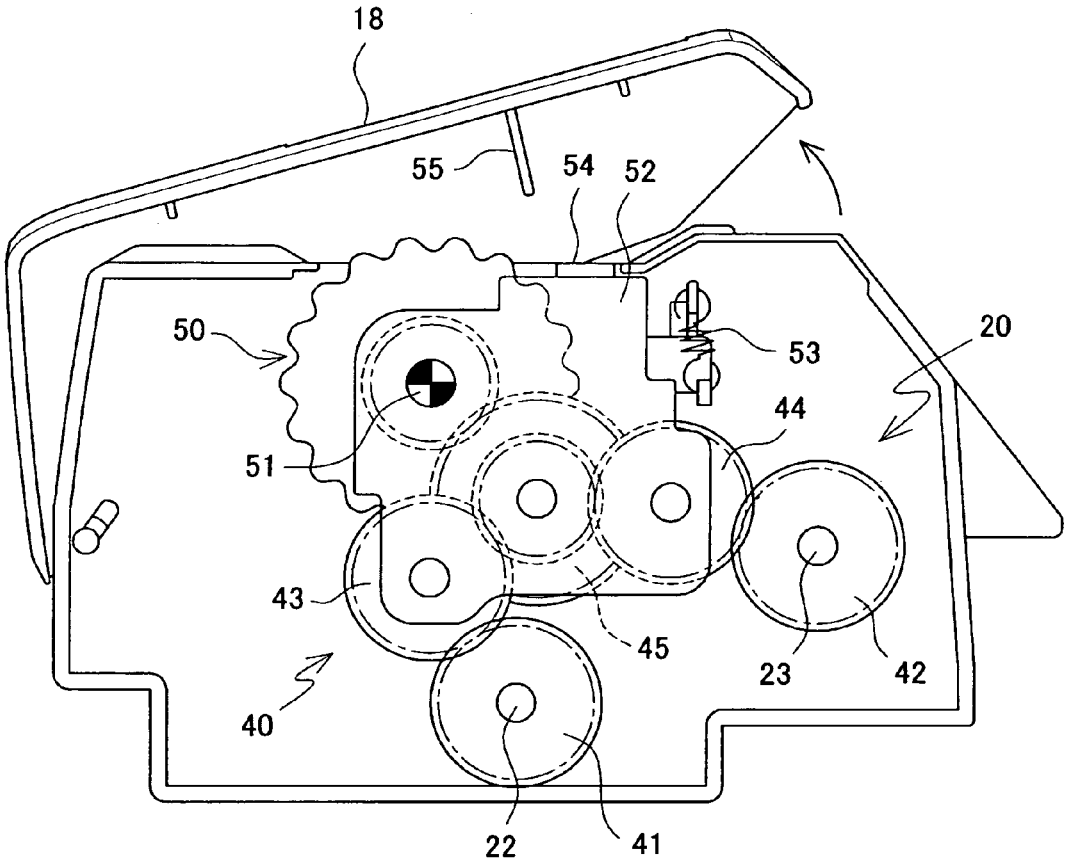
FIG. 7 is a sectional view illustrating action of the jam clearing mechanism when the open/close cover is opened.

Described is action in which the holder 52 is switched between two states, sheet transport and jam clearing, based on FIGS. 6 and 7. FIG. 6 shows the state in which the open/close cover 18 is closed in the close position for covering the entire sheet transport mechanism 20 including the jam clearing dial 50 to enable a sheet to be transported. In this state, when the open/close cover 18 is closed, a pressing protrusion 55 presses a pressing contact 54 of the holder 52, and the holder 52 thereby rotates about the dial rotating shaft 51 in the clockwise direction in the figure against the biasing spring 53. By this means, the reading driving gear 43 separates from the reading roller rotating gear 41, and the sheet discharge driving gear 44 also separates from the sheet discharge roller rotating gear 42.

FIG. 7 shows a state in which the open/close cover 18 is opened in the open position to open the upper portion of the sheet transport mechanism 20 and expose at least a part of the jam clearing dial 50 when a jam occurs and the like. In this state, when the open/close cover 18 is opened, the pressing member (pressing protrusion) 55 separates from the pressing contact 54 of the holder 52, and the holder 52 thereby rotates about the operation gear rotating shaft 51 in the counterclockwise direction in the figure by elastic force of the biasing spring 53. By this means, the reading driving gear 43 is coupled to the reading roller rotating gear 41, and concurrently, the sheet discharge driving gear 44 is also coupled to the sheet discharge roller rotating gear 42. Then, when the jam clearing dial 50 is manually rotated in a clockwise direction or counterclockwise direction, the rotation driving is conveyed to the reading roller driving shaft 22 from the first coupling gear 43, and further, is conveyed to the register roller driving shaft 21 from the reading roller driving shaft 22 via the first timing belt 25. In this way, it is possible to forcibly rotate the reading roller pair 14 and the sheet discharge roller pair 15 concurrently in the same direction, and the jammed sheet can be fed to the sheet discharge tray 4 or paper feed tray 3 side and removed.

Figure 8:
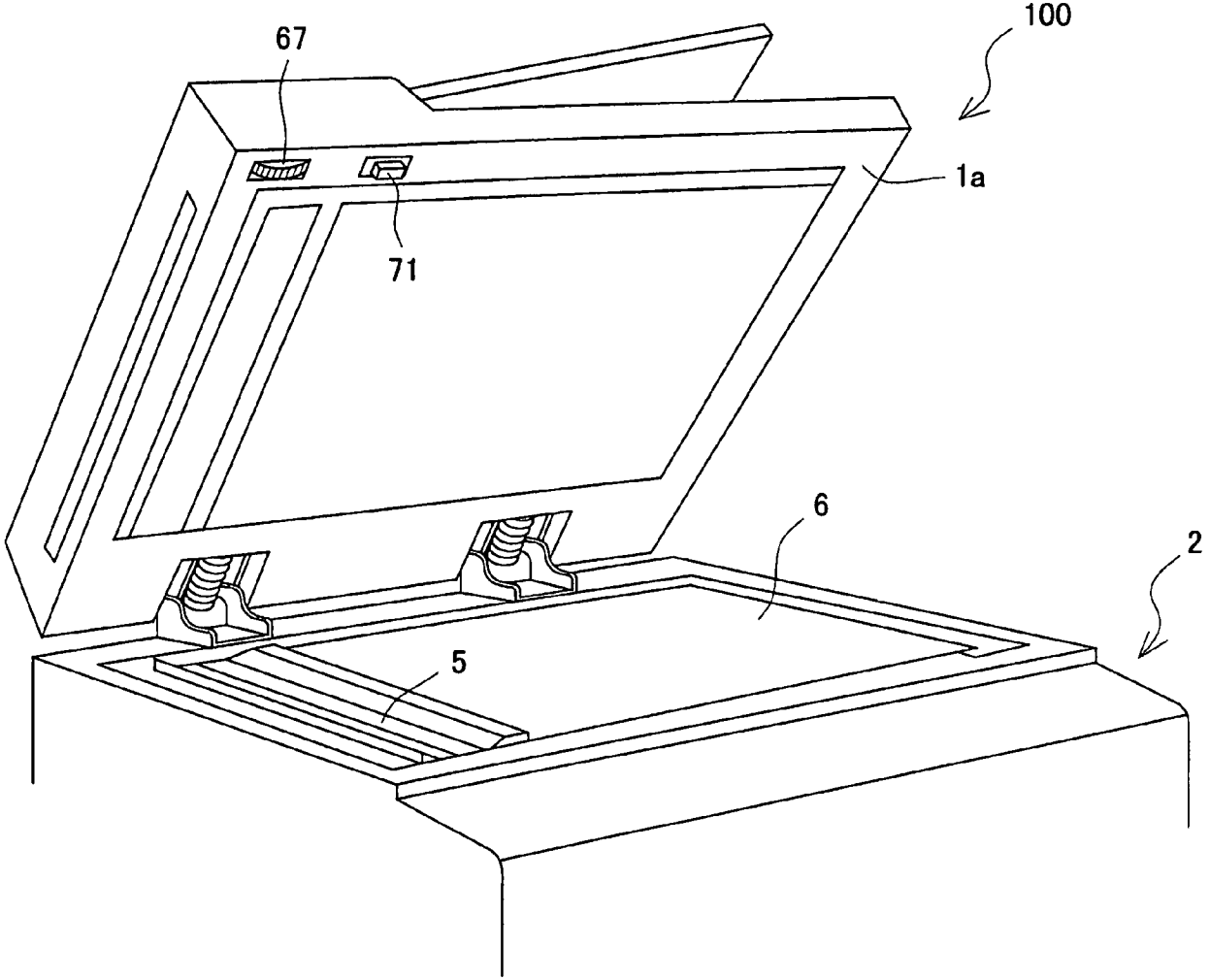
FIG. 8 is a perspective view of a sheet transport unit equipped with a jam clearing mechanism of Embodiment 2.
Figure 9A:
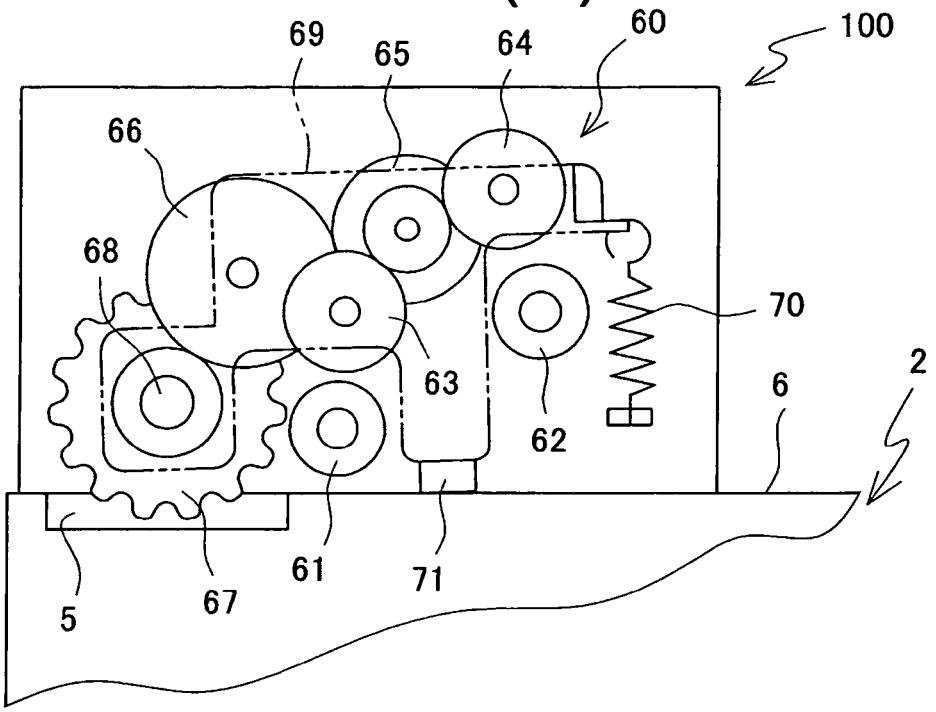
FIG. 9 is a sectional view illustrating action of the jam clearing mechanism of Embodiment 2.
Figure 9B:
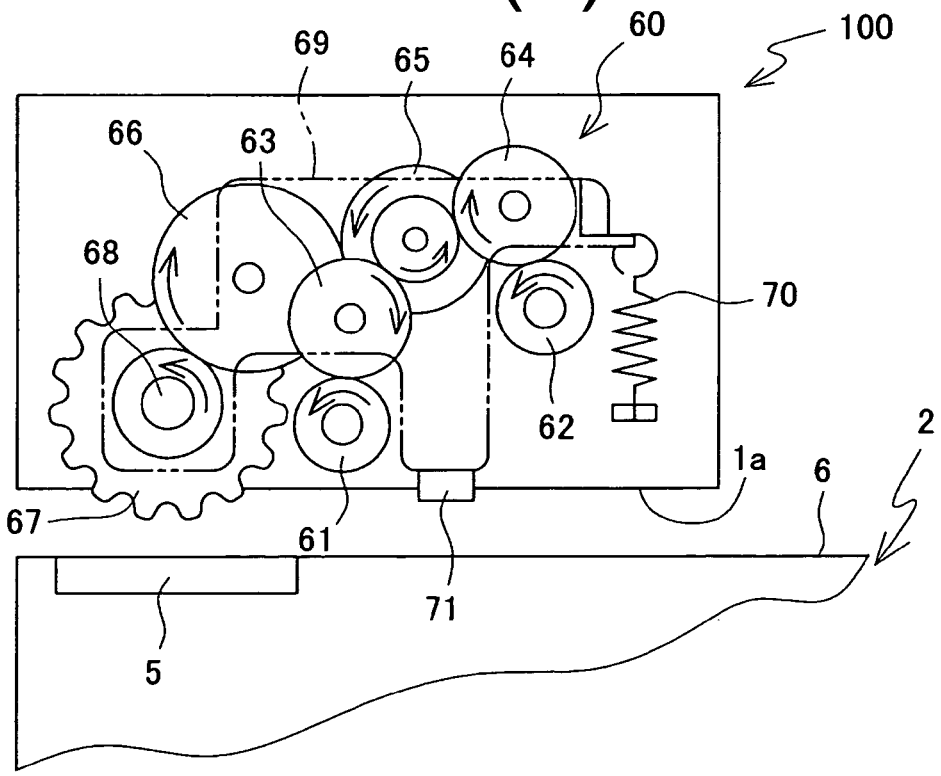

FIG. 8 illustrates a configuration and action of a sheet transport apparatus 100 provided with a jam clearing mechanism 60 of Embodiment 2. The sheet transport apparatus 100 has the configuration for separating by opening the top face of the reading apparatus body 2. As shown in FIG. 9(*a*), in transporting a sheet to read, the sheet transport apparatus 100 is mounted on the second platen 6. In mounting a sheet on the second platen 6 or maintaining, as shown in FIG. 9(*b*), the sheet transport apparatus 100 separates upward from the second platen 6.

The configuration of the sheet transport mechanism is the same as in Embodiment 1, and is described herein with reference numeral 61 being the reading roller rotating gear and reference numeral 62 being the sheet discharge roller rotating gear. The jam clearing mechanism 60 has a reading driving gear 63 and sheet discharge driving gear 64 capable of separating and being coupled respectively from/to the reading roller rotating gear 61 and the sheet discharge roller rotating gear 62, a first transfer gear 65 that meshes with the reading driving gear 63 and sheet discharge driving gear 64, a second transfer gear 66 that meshes with the first transfer gear 65, a jam clearing dial 67 that meshes with the second transfer gear 66, a support member (holder) 69, rotation-holding the gears, swingable about a dial rotating shaft 68, and a biasing spring 70 that biases the holder 69 to the second platen 6 side, and is comprised thereof. Further, the holder 69 is provided at its lower end with a contact member 71 protruding through the lower surface of the sheet transport apparatus 100.

As shown in FIG. 9(*a*), the contact member 71 comes into contact with the top face of the reading apparatus body 2, the holder 69 is thereby raised upward against the biasing spring 70, and the reading driving gear 63 and the sheet discharge driving gear 64 separate respectively from the reading roller rotating gear 61 and the sheet discharge roller rotating gear 62. By this means, the reading roller rotating gear 61 and the sheet discharge roller rotating gear 62 are capable of transporting a sheet smoothly without undergoing the effect of the jam clearing mechanism 60 with any excessive load not imposed on the driving motor.

When a sheet jam or the like occurs, as shown in FIGS. 8 and 9(*b*), the sheet transport apparatus 100 is lifted upward from the second platen 6 of the reading apparatus body 2 to separate. By this separation action, due to return action of the biasing spring 70, the holder 69 rotates about the dial rotating shaft 68 in a clockwise direction, and the reading driving gear 63 and the sheet discharge driving gear 64 are coupled respectively to the reading roller rotating gear 61 and the sheet discharge roller rotating gear 62. Then, as shown in FIG. 8, by manually rotating the jam clearing dial 67 with a part thereof exposed to the lower surface of the sheet transport apparatus 100, the reading roller rotating gear 61 and the sheet discharge roller rotating gear 62 rotate, the reading roller pair and the sheet discharge roller pair thereby feed the jammed sheet to the sheet discharge tray side or the paper feed tray side, and it is possible to remove the jammed sheet.

In this Embodiment, the first transfer gear 65 and the second transfer gear 66 are provided in between the jam clearing dial 67, and the reading roller rotating gear 61 and the sheet discharge roller rotating gear 62 to change the rotation direction, and it is thereby possible to coincide the rotation direction of the jam clearing dial 67 and the rotation directions of the reading roller rotating gear 61 and the sheet discharge roller rotating gear 62. By this means, it is possible to operate the jam clearing dial 67 as an image coinciding with the direction for removing the sheet.

In addition, the jam clearing mechanism in the sheet transport apparatus of the invention is configured to act on the reading roller pair and the sheet discharge roller pair provided in the sheet transport means, but is not limited thereto, and is capable of being configured to act on other transport rollers in which a jam tends to occur, and by adjusting the rotation transfer gear, it is possible to operate three transport rollers or more at the same time with a single jam clearing dial.

According to this Embodiment, the coupling members provided in the jam clearing mechanism are switched to separate from the transport rollers at the time of transporting a sheet and to be coupled to the transport rollers at the time of clearing a jam, and it is thereby possible to remove the jammed sheet with reliability and ease when a sheet jam or the like occurs, without causing any trouble in transporting sheets at the time of normal sheet transport.

Further, it is configured that the jam clearing mechanism is switched by open/close operation of the open/close cover for maintenance covering the upper portion of the transport path or operation for separating the sheet transport apparatus itself from above the reading apparatus, and it is thereby possible to halt transport of a sheet in synchronization with action for removing a jammed sheet and perform rotating operation of the jam clearing dial.

Furthermore, by only rotating operation of a single jam clearing dial provided in the jam clearing mechanism, it is possible to remove a sheet jammed over two transport rollers or more with ease without breaking the sheet.

This application claims priority from Japanese Patent Application No. 2011-049802 filed on Mar. 8, 2011 incorporated herein by reference.

The invention claimed is:

1. A sheet transport apparatus for transporting a sheet along a transport path, comprising:

a sheet transport mechanism having a plurality of transport rollers for transporting a sheet; and a jam clearing mechanism for removing the sheet when the sheet causes a transport failure and is jammed on the transport path, wherein the jam clearing mechanism has a jam clearing dial rotatable in two directions and a coupling device for transferring a rotation of the jam clearing dial to the transport rollers, and the coupling device is arranged not to transfer driving transmission between the jam clearing dial and the transport rollers at a time of transporting the sheet, and to transfer the driving transmission between the jam clearing dial and the transport rollers at a time of clearing a jam wherein the jam clearing mechanism has at least two coupling devices, each of the coupling devices including first and second coupling members connecting to and separating from each other, and a switching device to switch the coupling device between a state in which the jam clearing dial does not transfer the driving transmission to the transport rollers and a state in which the jam clearing dial transfers the driving transmission to the transport rollers, the switching device comprises a holder rotatably holding each of the first coupling members of the two coupling devices and a plurality of rotation transfer members that transfers rotation of the jam clearing dial to each of the first coupling members, the holder is arranged to be swingable about a rotating shaft of the jam clearing dial between a position in which each of the fast coupling members separates respectively from each of the second coupling members and a position in which each of the first coupling members is respectively coupled to each of the second coupling members, and the holder is structured to couple each of the first coupling members and the second coupling members at the time of transferring the sheet, and to separate each of the first coupling members and the second coupling members at the time of clearing the jam.

2. The sheet transport apparatus according to claim 1, wherein the coupling device comprises first and second coupling members connecting to and separating from each other, the sheet transport apparatus further comprises a switching device to separate the first and second coupling members at the time of transporting the sheet, and to couple the first and second coupling member at the time of clearing the jam, and the switching device comprises a holder, rotatably holding the first coupling member and the jam clearing dial, disposed inside the sheet transport mechanism to be swingable about a rotating shaft of the jam clearing dial.

3. The sheet transport apparatus according to claim 2, wherein the holder is biased to a position in which the first coupling member separates from the second coupling member at the time of transporting the sheet, while being biased to a position in which the first coupling member is coupled to the second coupling member at the time of clearing the jam.

4. The sheet transport apparatus according to claim 1, wherein the jam clearing mechanism has a rotation transfer device between the coupling device and the jam clearing dial, and by the rotation transfer device, transfers a rotation force and rotation direction of the jam clearing dial to the coupling device.

5. The sheet transport apparatus according to claim 1, wherein the jam clearing device has at least two coupling members, and a switching device operating so that the two coupling members are respectively coupled to two transport rollers among the plurality of transport rollers in clearing the jam, while separating respectively from the two rollers in transporting the sheet.

6. A sheet transport apparatus for transporting a sheet along a transport path, comprising:

a sheet transport mechanism having a plurality of transport rollers for transporting a sheet; and a jam clearing mechanism for removing the sheet when the sheet causes a transport failure and is jammed on the transport path, wherein the jam clearing mechanism has at least two coupling members coupled to the transport rollers, a jam clearing dial for transferring a rotation force to the transport rollers via the coupling members, and a switching device for switching so that the coupling members separate from the transport rollers in transporting the sheet, while being coupled to the transport rollers in clearing a jam, the switching means switches so that the two coupling members are respectively coupled to two transport rollers among the plurality of transport rollers in clearing the jam, while separating respectively from the two rollers in transporting the sheet, and the switching device comprises a holder that rotatably holds the two coupling members and a plurality of rotation transfer members that transfers rotation of the jam clearing dial to the two coupling members, and the holder is arranged to be swingable about a rotating shaft of the jam clearing dial between a position in which the two coupling members separate respectively from the two transport rollers and a position in which the two coupling members are respectively coupled to the two transport rollers.

7. A sheet transport apparatus for transporting a sheet along a transport path, comprising:

a plurality of transport rollers that transports a sheet;

a jam clearing dial that rotates the plurality of transport rollers to remove a sheet which causes a transport failure and is jammed on the transport path;

an open and close cover provided to be openable and closable between a close position for covering the jam clearing dial and an open position for exposing at least a part of the jam clearing dial;

first and second coupling members mutually coupled to transfer rotation of the jam clearing dial to a driving shaft of at least one transport roller among the plurality of transport rollers;

a support member that supports the first coupling member and that shifts to a first position for coupling the first coupling member to the second coupling member, and to a second position for separating the first coupling member from the second coupling member;

a biasing member that biases the support member in a direction of the first position; and a pressing member which is provided in the open and close cover, and comes into contact with the support member when the open and close cover is in the close position to press the support member in a direction of the second position against a biasing force of the biasing member.

8. The sheet transport apparatus according to claim 7, wherein the first and second coupling members are comprised of two gears that mesh with each other to be coupled to each other, and the support member is comprised of a holder that rotatably holds one of the two gears, while swinging about a rotating shaft of the jam clearing dial.

* * * * *